US007299634B2

(12) United States Patent
Stöcker et al.

(10) Patent No.: US 7,299,634 B2
(45) Date of Patent: Nov. 27, 2007

(54) COMBUSTION CHAMBER

(75) Inventors: Bernd Stöcker, Oberhausen (DE); Marc Tertilt, Hattingen (DE)

(73) Assignee: Siemens Aktiengesellschaft, Munich (DE)

( * ) Notice: Subject to any disclaimer, the term of this patent is extended or adjusted under 35 U.S.C. 154(b) by 50 days.

(21) Appl. No.: 10/554,033

(22) PCT Filed: Apr. 5, 2004

(86) PCT No.: PCT/EP2004/003584

§ 371 (c)(1),
(2), (4) Date: Oct. 20, 2005

(87) PCT Pub. No.: WO2004/097301

PCT Pub. Date: Nov. 11, 2004

(65) Prior Publication Data

US 2006/0207263 A1 Sep. 21, 2006

(30) Foreign Application Priority Data

Apr. 30, 2003 (EP) ..... 03009942

(51) Int. Cl.

| | |
|---|---|
| ***F02C 1/00*** | (2006.01) |
| ***F02C 9/28*** | (2006.01) |
| ***F23R 3/00*** | (2006.01) |
| ***F23M 5/00*** | (2006.01) |
| ***F01D 21/12*** | (2006.01) |

(52) U.S. Cl. ..... 60/752; 60/755; 60/39.281; 324/700

(58) Field of Classification Search ..... 60/752, 60/755–757, 39.281; 431/21; 324/700
See application file for complete search history.

(56) References Cited

U.S. PATENT DOCUMENTS

| | | | | |
|---|---|---|---|---|
| 2,565,350 | A * | 8/1951 | Burns et al. | 236/15 R |
| 2,915,305 | A | 12/1959 | Craig | |
| 3,229,464 | A * | 1/1966 | Mock | 60/758 |
| 3,497,397 | A * | 2/1970 | Huber | 136/208 |
| 3,527,620 | A * | 9/1970 | Meador | 136/201 |
| 4,527,908 | A * | 7/1985 | Arisi | 374/147 |
| 4,838,030 | A | 6/1989 | Cramer | |
| 5,628,185 | A * | 5/1997 | Rowe | 60/39.281 |
| 5,635,909 | A | 6/1997 | Cole | |
| 6,363,330 | B1 * | 3/2002 | Alag et al. | 702/132 |
| 6,686,752 | B1 * | 2/2004 | Heumann et al. | 324/700 |
| 2004/0007196 | A1 | 1/2004 | Young et al. | |

FOREIGN PATENT DOCUMENTS

| | | |
|---|---|---|
| DE | 197 27 407 A1 | 1/1999 |
| EP | 1 367 240 A2 | 12/2003 |
| GB | 1 250 369 | 10/1971 |

* cited by examiner

*Primary Examiner*—Ted Kim

(57) ABSTRACT

A combustion chamber (4) for a gas turbine (1), the combustion chamber wall (24) of which is furnished on the inside with a lining formed of a number of heat shield elements (26), is to be designed for a particularly high level of operating safety. To this end, one or a number of temperature sensors (28) is/are located according to the invention between combustion chamber wall (24) and heat shield elements (26).

13 Claims, 3 Drawing Sheets

COMBUSTION CHAMBER

CROSS REFERENCE TO RELATED APPLICATION

This application is the U.S. National Stage of International Application No. PCT/EP2004/003584, filed Apr. 5, 2004 and claims the benefit thereof. The International Application claims the benefits of European Patent applications No. 03009942.8 EP filed Apr. 30, 2003, all of the applications are incorporated by reference herein in their entirety.

FIELD OF THE INVENTION

The invention relates to a combustion chamber for a gas turbine, the combustion chamber wall of which is furnished on the inside with a lining formed of a number of heat shield elements. The invention also relates to a gas turbine with a combustion chamber of this type.

BACKGROUND OF THE INVENTION

Combustion chambers are among other things an integral part of gas turbines, which are used in many fields for driving generators or machines. Here, the energy content of a fuel is used for generating a rotational movement of a turbine shaft. To this end, the fuel is burnt by burners in the combustion chambers connected downstream of said burners, compressed air being supplied by an air compressor.

Each burner can be assigned a separate combustion chamber, whereby it is possible for the working medium flowing out of the combustion chambers to be merged upstream of or in the turbine unit. Alternatively, the combustion chamber can also be laid out in a construction design referred to as an annular combustion chamber, in which a majority, in particular all, of the burners discharge into a common, usually ring-shaped, combustion chamber.

Burning the fuel produces a working medium under high pressure and with a high temperature. This working medium expands in the turbine unit connected downstream of the combustion chambers, performing work as it does so. To this end, the turbine unit has a number of rotatable moving blades connected to the turbine shaft. The moving blades are arranged on the turbine shaft in the form of a ring and thus form a number of rows of moving blades. The turbine also comprises a number of fixed guide vanes which are likewise fastened annularly on an inner housing of the turbine forming rows of guide vanes. The moving blades serve here to drive the turbine shaft by transferring a pulse from the working medium flowing through the turbine. Each of the guide vanes on the other hand serves to guide the flow of the working medium between two successive (viewed from the direction of flow of the working medium) moving-blade rows or moving-blade rings. A consecutive pair consisting of a ring of guide vanes or a guide-vane row and a ring of moving blades or a moving-blade row connected downstream in terms of the direction of flow of the working medium forms a turbine stage.

In the design of gas turbines of this type, one of the design goals is, in addition to the power achievable, a particularly high degree of efficiency. For thermodynamic reasons, an increase in the degree of efficiency can basically be achieved by increasing the exit temperature at which the working medium flows out of the combustion chamber and into the turbine unit. Temperatures of approximately 1200° C. to 1500° C. are therefore aimed at and also achieved for gas turbines of this type.

With such high temperatures of the working medium, however, the components and structural members exposed to this medium are exposed to high thermal loadings. However, in order to ensure with a high degree of reliability a comparatively long service life of the affected components, a design is usually required that comprises particularly heat-resistant materials and a cooling of the components concerned, in particular of the combustion chamber.

The combustion chamber wall is to this end generally furnished on its inside with an inner lining consisting of heat shield elements, which inner lining can be furnished with particularly heat-resistant protective layers and which can be cooled through the actual combustion chamber wall. To do this, a cooling procedure is generally used that is also referred to as "impact cooling". In impact cooling, a coolant, generally cool air, is fed through a number of bore holes in the combustion chamber wall to the heat shield elements so that the coolant essentially impacts vertically onto their external surface facing the combustion chamber wall. The coolant heated up through the cooling process is then removed from the inner cavity which the combustion chamber wall forms with the heat shield elements.

In order to fasten the heat shield elements to the combustion chamber wall, there is firstly the option of connecting these to the combustion chamber wall with screws or fastening bolts. Alternatively, heat shield elements can also be anchored to the combustion chamber wall by means of appropriate holding devices onto grooves which are located in the combustion chamber wall.

A problem when operating a gas turbine is the fact that heat shield elements or even parts thereof can work loose from the combustion chamber wall. As a rule, this happens because the heat shield elements or their fastening devices are damaged by the extreme influences in the interior of the combustion chamber such as the high thermal loadings or shocks or vibrations of the combustion chamber. As a result of the flow movement of the working medium, these parts which have been loosened from the combustion chamber wall enter the turbine unit where they can destroy moving blades and guide vanes. Where there is this kind of loss of heat shield elements, loosened heat shield elements or parts thereof do not, however, enter the turbine unit since they accumulate in front of the first row of guide vanes of the first turbine stage or wedge in front of or in guide vanes of this first turbine stage. The presence of heat shield elements or parts thereof in front of the turbine unit leads, when the gas turbine is operating, to flow and pressure fluctuations in the form of flow turbulences in the turbine unit. These turbulences are generally so strong that moving blades such as in particular the moving blades of the first turbine stage snap off and thereby destroy large parts of the turbine unit, as well as the neighboring and adjoining rows of guide vane and moving blades. As a rule, in the event of a heat-shield loss, some minutes pass between the working loose of a heat shield element on the combustion chamber wall and the first breakages of moving blades, triggered by turbulences caused by jammed heat shield elements. In the event of the turbine unit being damaged, in addition to repair costs, loss-of-production costs of the gas turbine, in particular, can also accrue so that very high total costs can accrue.

SUMMARY OF THE INVENTION

The object of the invention is therefore to indicate a combustion chamber of the aforementioned type in which a particularly high level of operational safety can be achieved.

With regard to the combustion chamber, this object is achieved according to the invention in that one temperature sensor or a number of temperature sensors is/are arranged between combustion chamber wall and heat shield elements.

The invention proceeds here on the basis that in order to ensure a high level of operating safety of the combustion chamber, destruction of the turbine by heat shield elements which have worked loose has to be avoided. Where heat shield elements are lost, it should therefore be possible, if a heat shield element works loose, for the gas turbine to be switched off. For this to occur, it would have to be possible for the loss of a heat shield element on the combustion chamber wall to be recorded in good time. The loss of a heat shield element can be detected in a particularly simple way through the change in temperature which occurs in the combustion chamber wall. When a heat shield is detached from the combustion chamber wall, the otherwise cooled interspace between combustion chamber wall and heat shield element will heat up comparatively quickly and sharply due to the lack of thermal insulation from the interior of the combustion chamber or the combustion chamber wall will, in the area of the missing lining from the inner wall, virtually match the temperatures in the interior of the combustion chamber. This temperature difference which occurs when a heat shield element is detached can be measured with temperature-dependent sensors, in which the temperature dependence is given in particular by the electrical resistance or the fusion behavior, and the absence of a heat shield element can thus be detected indirectly.

In order to monitor with one temperature sensor a plurality of heat shield elements of the lining of the combustion chamber simultaneously for their completeness or for a possible fault, a temperature sensor is advantageously fashioned as a structural member stretched along a direction of extension. In this way, this temperature sensor can be positioned along the wall of the combustion chamber and monitor all the heat shield elements which are located between temperature sensor and the interior of the combustion chamber. A particularly simple structural design can also be achieved overall by this means.

In order to fix a temperature sensor to the combustion chamber wall and to guide it along said wall, said temperature sensor is usefully located in an assigned groove in a circumferential direction in the combustion chamber wall.

In order reliably to detect the temperature change in the combustion chamber wall when a heat shield element is lost, different design variants are feasible.

In a first variant, a temperature sensor consists preferably of an electrically conductive fusible wire. In the area of a missing heat shield element the wire melts when the melting temperature is exceeded and thereby destroys the electrical conductivity. The resulting sharp increase in resistance or the breakage of the fusible wire can in turn be measured and the loss of a heat shield element shown by this.

A fusible wire advantageously has a melting temperature of between 300° C. and 1000° C., preferably between 500° C. and 700° C. This temperature range is chosen such that the melting temperature lies between on the one hand the temperature of the cooled side of the heat shield elements and the combustion chamber wall in normal operations and the very much higher temperature of the unprotected combustion chamber wall on the other, so that where a heat shield element is lost the melting temperature of the fusible wire will be exceeded comparatively quickly and clearly.

In a second variant, the temperature sensor is advantageously formed of a current-carrying wire which exhibits a temperature-dependent electrical conductance, so that this temperature sensor is not destroyed in the event of a heat shield element being lost. Where there is a change in temperature in the area of the wire, the temperature-dependent resistance of the wire, and thus also the current which flows through the wire, changes, by means of which the loss of a heat shield element can be detected.

In order to use an active signal for the loss of a heat shield element, a temperature sensor usefully consists of a thermocouple. A change of temperature and thus loss of a heat shield element in the area of the thermocouple can be detected in this thermocouple via a change in the thermoelectric voltage.

In order, where thermocouples are used to monitor the heat shield elements, that a plurality of heat shield elements in the lining of the combustion chamber can simultaneously be monitored with one measuring circuit as to their completeness or for a possible absence of a heat shield element, a temperature sensor preferably consists of a series connection of thermocouples. A change in the voltage of a thermocouple triggered by an increase in temperature can be monitored by monitoring the overall voltage of the series circuit, since the output voltages of the individual thermocouples accumulate because of the series connection.

In order to design the structure of an appropriate measuring circuit for monitoring the heat shield elements as simply as possible, a temperature sensor consists usefully of a sheathed thermocouple. This sheathed thermocouple consists advantageously of two parallel thermoelectric wires which are insulated from one another lengthwise by a material having a positive temperature coefficient. Where there is an increase in temperature at one point of the endless thermocouple, the electrical resistance in the insulation material of the heated-up area falls so that the thermoelectric voltage between the two thermoelectric wires increases. The thermoelectric voltage therefore corresponds approximately to the maximum temperature in the course of the sheathed thermocouple.

In order to monitor the entire combustion chamber during operation continuously for possible losses of heat shield elements, sensors are preferably connected to an assigned evaluation circuit which monitors via the temperature sensors the temperature distribution of the combustion chamber and thereby records the loss of heat shield elements or of parts thereof.

The above-mentioned combustion chamber is preferably an integral part of a gas turbine.

In order to avoid damage from heat shield elements or parts thereof which have worked loose in the area of the turbine unit of the gas turbine, the gas turbine can advantageously be switched off automatically via the evaluation circuit. In the event of the loss of a heat shield element being detected by temperature sensors or by the evaluation circuit connected downstream, then in particular the combustion chamber as well as the turbine can be brought to a stop promptly after the loss of a heat shield element.

The advantages achieved with the invention consist in particular in that loss of a heat shield element or of parts thereof is reliably detectable as a result of the positioning of temperature sensors between combustion chamber wall and heat shield elements of a combustion chamber and damage therefrom in the turbine unit connected downstream of the combustion chamber can be avoided by the gas turbine being automatically shut down in the event of the loss of a heat shield element by the evaluation circuit connected downstream of the temperature sensors. The advantage of using temperature sensors which are fashioned in particular along a run is that not every heat shield element has to be individually equipped with a temperature sensor, but a plurality of heat shield elements can be monitored by means of one temperature sensor or one measuring circuit. The use of thermocouples and in particular of a sheathed thermocouple has, in addition to providing a good facility for monitoring the heat shield elements and ease of evaluation of the output signal, the advantage that thermocouples can be used for very high temperatures and are therefore recommended for monitoring the heat shield elements in the combustion chamber wall.

BRIEF DESCRIPTION OF THE DRAWINGS

An embodiment will be explained in detail with reference to the drawings, in which.

DETAILED DESCRIPTION OF THE INVENTION

Figure 1:
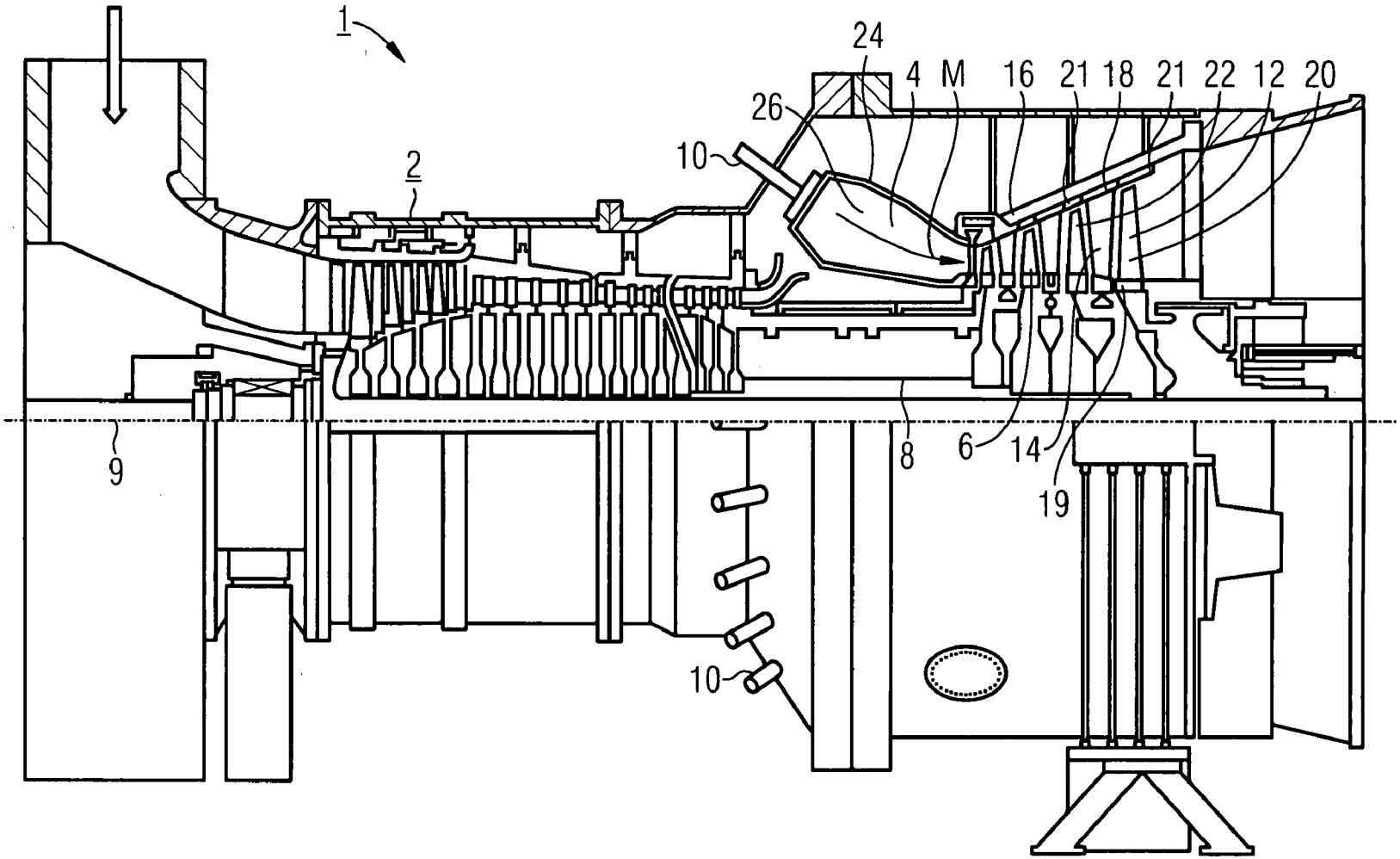
FIG. 1 shows a half section through a gas turbine.

Identical parts are labeled in all the Figures with the same reference characters.

The gas turbine 1 according to FIG. 1 has a compressor 2 for combustion air, a combustion chamber 4 and a turbine 6 for driving the compressor 2 and a generator (not shown) or a machine. For this purpose, the turbine 6 and the compressor 2 are arranged on a common turbine shaft 8, also called a turbine rotor, to which the generator or the machine is also connected and which runs on bearings rotatably about its center axis 9. The combustion chamber 4, which is fashioned in the form of an annular combustion chamber, is fitted with a number of burners 10 for burning a liquid or gaseous fuel.

The turbine 6 has a number of rotatable moving blades 12 connected to the turbine shaft 8. The moving blades 12 are arranged on the turbine shaft 8 in the form of a ring and thus form a number of rows of moving blades. The turbine 6 also comprises a number of fixed guide vanes 14 which are likewise fastened annularly to an inner housing 16 of the turbine 6, forming rows of guide vanes. The moving blades 12 serve to drive the turbine shaft 8 by transferring a pulse from the working medium M flowing through the turbine 6. The guide vanes 14, on the other hand, serve to guide the flow of the working medium M between in each case two, viewed in the direction of flow of the working medium M, consecutive moving blade rows or moving blade rings. A consecutive pair comprising a ring of guide vanes 14 or a row of guide vanes and a ring of moving blades 12 or a row of moving blades is also referred to as a turbine stage.

Each guide vane 14 has a platform 18, also designated the footing of the blades, which is arranged on the internal housing 16 of the turbine 6 as a wall panel for fixing the respective guide vane 14. The platform 18 is thermally a comparatively heavily loaded component which forms the outer limit of a hot-gas channel for the working medium M flowing through the turbine 6. Each moving blade 12 is fastened in an analogous manner via a platform 20, also designated the footing of the blade, to the turbine shaft 8.

Between the platforms 18, arranged at a distance from one another, of the guide vanes 14 of two adjacent rows of guide vanes there is arranged in each case a guide ring 21 on the internal housing 16 of the turbine 6. The outer surface of each guide ring 21 is likewise exposed to the hot working medium M flowing through the turbine 6 and separated in a radial direction from the outer end 22 of the moving blade 12 lying opposite to it by a gap. The guide rings 21 arranged between adjacent rows of vane guides serve in particular as shielding elements which protect the inner wall 16 or other built-in housing components from thermal overloading by the hot working medium M flowing through the turbine 6.

The combustion chamber 4 is designed in the embodiment as an annular combustion chamber in which a large number of burners 10 arranged in a circumferential direction around the turbine shaft 8 discharge into a common combustion chamber space. To this end, the combustion chamber 4 is designed overall as a ring-shaped structure which is positioned around the turbine shaft 8.

In order to achieve a comparatively high degree of efficiency, the combustion chamber 4 is designed for a comparatively high temperature of the working medium M of approximately 1000° C. to 1600° C. In order to enable a comparatively long service life even given these operating parameters, which are unfavorable for the materials, the combustion chamber wall 24 is provided on the side facing the working medium M with an internal lining formed of heat shield elements 26. Each heat shield element 26 is furnished on the side facing the working medium with a particularly heat-resistant protective layer or is manufactured from material which is stable at high temperatures. Due to the high temperatures in the interior of the combustion chamber 4, a cooling system is additionally provided for the heat shield elements 26 or for their holding elements.

Figure 2:
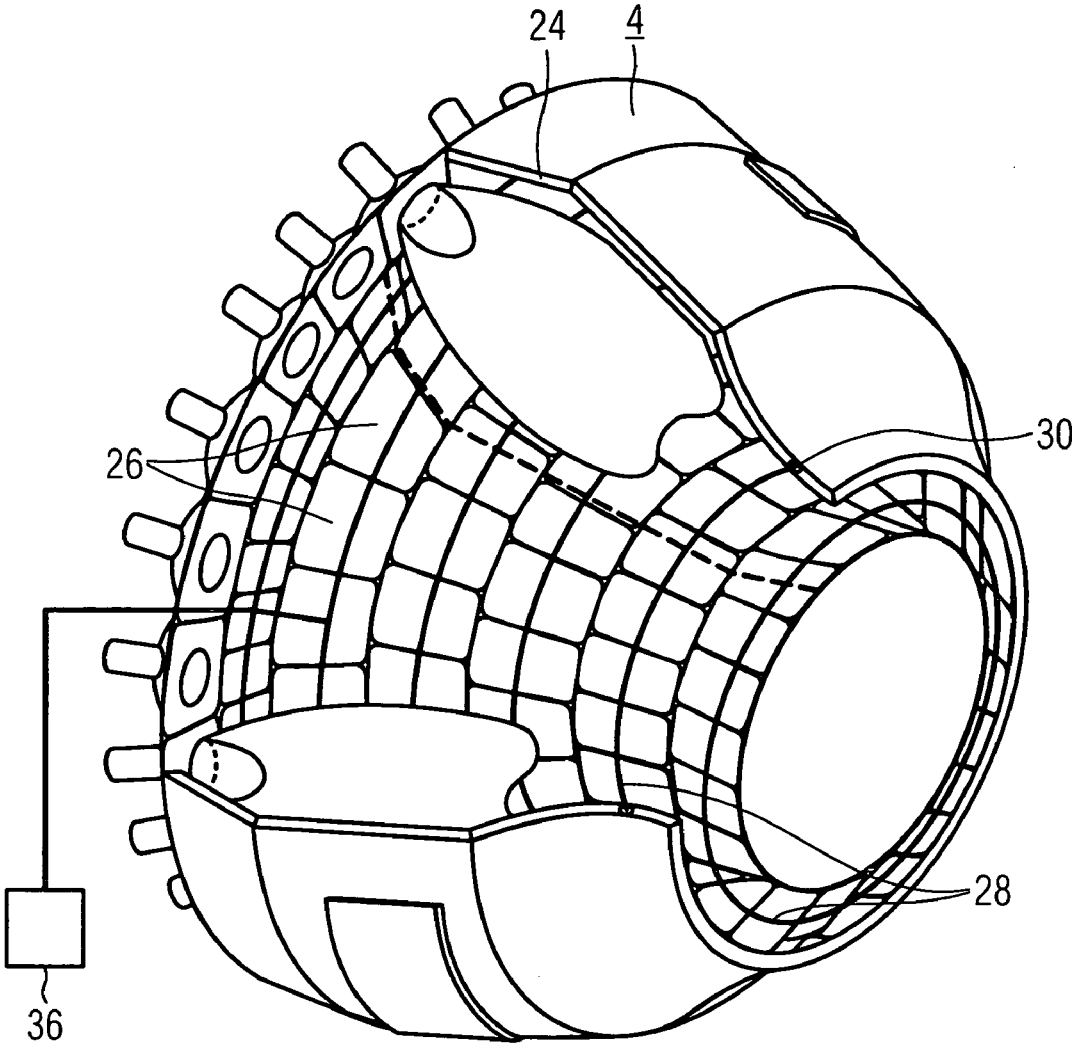
FIG. 2 shows the combustion chamber of the gas turbine according to FIG. 1.
Figure 3:
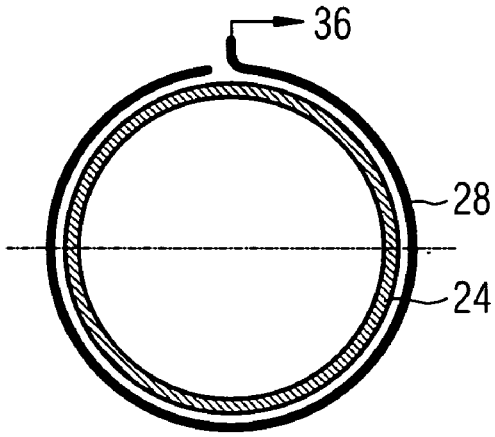
FIG. 3 shows a temperature sensor arranged in a direction of circumference of the combustion chamber.

The combustion chamber 4 is designed in particular for detecting losses of heat shield elements 26. To this end, a number of temperature sensors 28 are positioned between the combustion chamber wall 24 and the heat shield elements 26, each temperature sensor running, stretched lengthwise, in a groove 30 in the combustion chamber wall 24, whereby each of these temperature sensors surrounds the heat shield elements 26 in the direction of the circumference of the combustion chamber 4, as can be seen from FIG. 2. In order to be able to measure a temperature increase resulting from the loss of a heat shield element 26 in the combustion chamber wall 24, the temperature sensor 28 consists optionally of a current-carrying fusible wire, one or more thermocouples or one sheathed thermocouple 31. The temperature sensor 28 is designed in particular, as shown schematically in FIG. 3, as a monitoring element extended in the direction of circumference of the combustion chamber 4 and stretched out lengthwise.

Figure 4:
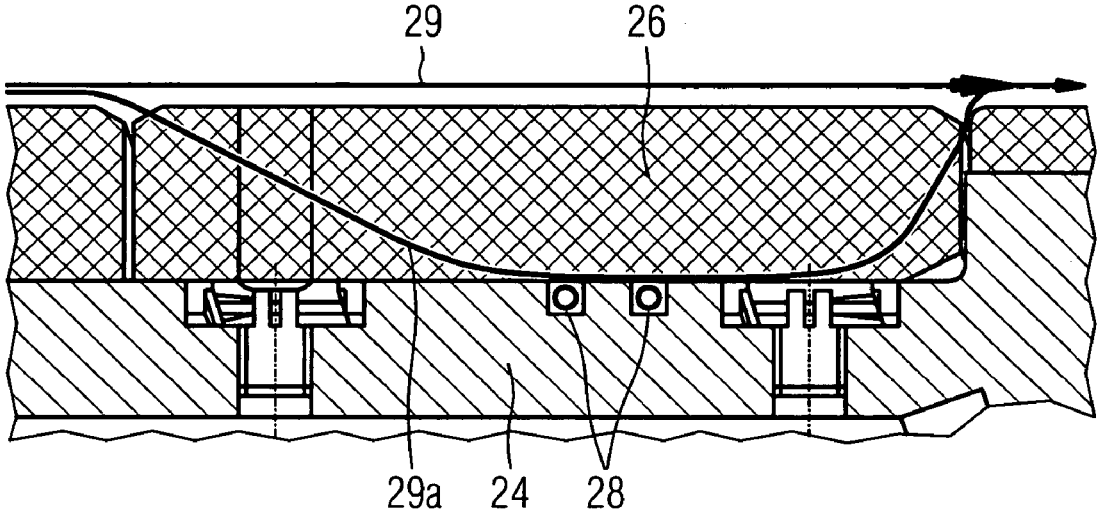
FIG. 4 shows a section taken from the wall of the combustion chamber according to FIG. 2.

To illustrate the mode of operation of the temperature sensor 28, a section of the combustion chamber wall 24 is shown in FIG. 4. Where there are intact and properly installed heat shield elements 26, these are thermally loaded via the working medium M from the interior of the combustion chamber 4, whereby the isotherm 29, i.e. the equal-temperature contour, runs essentially parallel to the inner wall. There exists a considerable temperature gradient across the thickness of the heat shield element 26 such that the temperature sensors 28 arranged on the cool side of the heat shield elements are subject to only a comparatively low temperature. If, however, a heat shield element 26 should be lost, then the isotherm 29*a* appears. In this case, the temperature sensor 28 is thus subjected to a significantly increased temperature such that, depending on the design, for example, a significant change in the electrical resistance or in the electrical conductance or the melting through of a fusible wire can be identified.

Figure 5:
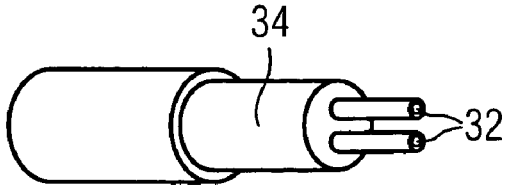
FIG. 5 shows a section through a sheathed thermocouple.

A cross-sectional diagram of this temperature sensor 28 is presented in FIG. 5. As can be seen from the Figure, the sheathed thermocouple (31) is composed of two thermally conductive wires 32, arranged parallel to one another, which are located in a temperature-dependent insulating material 34 and are insulated lengthwise from one another by said material. The materials of the thermally conductive wires 32, the temperature coefficient of the insulating compound and the dimensioning of the entire sheathed thermocouple are matched to the temperature ranges to be measured in the combustion chamber wall 24 such that where a heat shield element 26 is lost, the electrical resistance in the insulating material 34 of the heated area falls and thus the thermoelectric voltage between the two thermoelectric wires 32 increases.

In order to be able to record centrally the loss of heat shield elements, all temperature sensors 28 are connected to the evaluation circuit 36. This is designed in particular to switch off the gas turbine 1 in the event of the loss of a heat shield element 26. For this reason, it is connected to the relay control of the gas turbine 1.

The invention claimed is:

1. A combustion chamber for a gas turbine, comprising:

a combustion chamber wall having grooves oriented circumferentially to an axial direction of the combustion chamber;

a lining formed from a plurality of solid heat shield elements furnished directly on the inside of the combustion chamber; and a plurality of temperature sensors that output sensor signals arranged completely between the combustion chamber wall and the plurality of heat shield elements and arranged in the circumferential grooves where each of the temperature sensors surround the heat shield elements in the circumferential direction of the combustion chamber, the sensor signals used to determine a failure of one or more of the heat shield elements.

2. The combustion chamber according to claim 1, wherein the temperature sensors are a structural member expanded along a direction of extension.

3. The combustion chamber according to claim 1, wherein the temperature sensors are each formed of an electrically conductive fusible wire.

4. The combustion chamber according to claim 3, wherein the respective electrically conductive fusible wire has a melting temperature between approximately 300° C. and approximately 1000° C.

5. The combustion chamber according to claim 1, wherein the temperature sensor is formed from a current-carrying wire which has a temperature-dependent electric conductance.

6. The combustion chamber according to claim 1, wherein at least some of the temperature sensors are formed of thermocouples.

7. The combustion chamber according to claim 1, wherein at least some of the temperature sensors are formed of a series connection of thermocouples.

8. The combustion chamber according to claim 1, wherein the temperature sensors are formed of a sheathed thermocouple.

9. The combustion chamber according to claim 8, wherein the sheathed thermocouple is composed of two parallel thermoelectric wires that are separated from one another lengthwise by a temperature-dependent insulating material.

10. The combustion chamber according to claim 1, wherein the temperature sensors are connected to an assigned evaluation circuit.

11. A gas turbine, comprising;

a turbine section;

a compressor section; and a combustion chamber, comprising:

a combustion chamber wall having grooves oriented circumferentially to an axial direction of the combustion chamber;

a lining formed from a plurality of solid heat shield elements furnished directly on the inside of the combustion chamber;

a plurality of temperature sensors that output sensor signals arranged completely between the combustion chamber well and the plurality of heat shield elements and arranged in the circumferential grooves where each of the temperature sensors surround the heat shield elements in the circumferential direction of the combustion chamber, the sensor signals used to determine a failure of one or more of die heat shield elements.

12. The gas turbine according to claim 11, wherein the temperature sensors are connected to an assigned evaluation circuit.

13. The gas turbine according to claim 12, wherein the gas turbine is automatically disconnectable via the evaluation circuit.

* * * * *